US005992908A

United States Patent [19]

Yared et al.

[11] Patent Number: 5,992,908

[45] Date of Patent: Nov. 30, 1999

[54] SINGLE LEVER DRAW LATCH

[76] Inventors: Linda Sue Yared, 105 S. Western Av., New Hampton, Iowa 50659; Christopher Wildeboer, 1340 Gilmore Av., Alta Vista, Iowa 50603; Gene Charles Light, 124 Hidden Meadow La., Denver, Iowa 50622

[21] Appl. No.: 08/974,202

[22] Filed: Nov. 19, 1997

[51] Int. Cl.[6] ..... E05C 3/08

[52] U.S. Cl. ..... 292/196; 292/197; 292/DIG. 31

[58] Field of Search ..... 292/97, 98, 129, 292/182, 196, 197, 229, DIG. 31, DIG. 60; 70/208, 210

[56] References Cited

U.S. PATENT DOCUMENTS

| | | | |
|---|---|---|---|
| 1,558,980 | 10/1925 | Halinka . | |
| 2,642,300 | 1/1953 | Pelcin . | |
| 3,423,118 | 1/1969 | Waldo . | |
| 3,707,862 | 1/1973 | Pastva | 70/150 |
| 4,003,593 | 1/1977 | Wilzig | 292/92 |
| 4,159,137 | 6/1979 | Richter | 292/123 |
| 4,192,536 | 3/1980 | Laureano | 292/228 |
| 4,320,642 | 3/1982 | Pastva | 70/472 |
| 4,632,438 | 12/1986 | McKinney | 292/87 |
| 4,856,832 | 8/1989 | Prevot | 292/341.19 |
| 5,072,977 | 12/1991 | Millman | 292/336.3 |
| 5,409,282 | 4/1995 | McCormack | 292/66 |
| 5,664,813 | 9/1997 | Gromotka | 292/229 |

OTHER PUBLICATIONS

Six (6) Photographs of a TRI/MARK Latch.

*Primary Examiner*—Flemming Saether
*Assistant Examiner*—Gary Estremsky
*Attorney, Agent, or Firm*—Wood, Phillips, VanSanten, Clark & Mortimer

[57] ABSTRACT

A latch has a housing and an operating mechanism mounted on the housing. The operating mechanism has a latch arm pivotably mounted for movement relative to the housing between a latched position in which the latch arm is abuttable against a strike element and an unlatched position. The latch arm has a cam surface. The operating mechanism also has a lever pivotably mounted for movement relative to the housing between first and second operative positions. The lever has an edge which moves along the cam surface as the lever is moved from the second operative position to the first operative position to thereby move the latch arm from the unlatched position to the latched position.

19 Claims, 7 Drawing Sheets

SINGLE LEVER DRAW LATCH

FIELD OF THE INVENTION

The present invention is directed to latches as used to releasably maintain a movable closure in a closed state.

BACKGROUND OF THE INVENTION

Single lever draw latches are known in the art. A single lever draw latch, for example mounted on a door, uses a simple lever device to produce a force to draw the door towards, and to secure the door to, a strike element, such as those commonly mounted on recreational vehicles. Typically, the door is pivotably mounted on the recreational vehicle. Thus, the door can be pivoted between a fully open position and a fully closed position, with the draw latch and the strike element cooperating to secure the door in the closed position.

The draw latch has a lever arm which is pivotably mounted to a latch housing which is mounted on the door. The lever arm has a first end for receiving the strike element and a second end with a handle. The lever arm can be pivoted between a first position, wherein the second end is substantially flush with an exterior surface of the door, and a second position, wherein the second end protrudes significantly from the exterior surface of the door. If the door is pivoted such that the first end of the lever arm abuts the strike element, then movement of the lever arm from the second position to the first position will cause the first end of the lever arm and the strike element to cooperate to secure the door in the fully closed position. Alternatively, if the lever arm is moved from the first position to the second position, the first end of the lever arm and the strike element are spaced such that the door may be pivoted out of the fully closed position to the fully open position.

Because the second end of the lever arm protrudes significantly from the exterior surface of the door in the second position, pivoting the door to the fully open position with the lever arm in the second position can cause the second end of the lever arm to hit an exterior side of the recreational vehicle, which may damage the side of the recreational vehicle. The damage may result in warranty claims by the purchaser of the recreational vehicle on which the latch is mounted and general customer dissatisfaction.

Alternatively, as soon as the door is pivoted such that the first end can no longer receive the strike element, the lever arm can be rotated into the first position, such that the second end of the lever arm is flush with the exterior of the door. This may prevent damage to the side of the vehicle caused by the second end of the lever arm when the door is moved into the fully opened position.

However, in moving the lever arm into the first position, the first end of the lever arm protrudes from the door. Unless the vehicle user remembers to move the lever arm into the second position before attempting to close the door, the force generated when the first end of the lever arm collides with the strike element may damage the strike element and possibly knock the draw latch out of alignment.

Additionally, the setting of the lever to generate the force to secure the door to the strike element may vary over time, requiring frequent adjustment.

It is also known in the art to have a latch with a lever arm made of two pieces: a first piece for receiving the strike element and a second piece having a handle. Both pieces are pivotably attached to the latch housing. The second piece can be moved from a first position substantially flush with the exterior surface of the door on which the latch is mounted to a second position in which the second piece abuts the first piece to move the first piece into a position in which the first piece cannot receive the strike element. The second piece is biased in the first position, while the first piece is biased such that it ordinarily would be disposed to receive the strike element.

Because the first piece is biased so that it would ordinarily be disposed to receive the strike element, if the first piece is not first moved into a position in which the first piece cannot receive the strike element when the door which the latch is mounted on is closed, the collision of the first piece with the strike element may cause damage to the strike element, the latch, or both.

SUMMARY OF THE INVENTION

According to an aspect of the present invention, a latch has a housing and an operating mechanism mounted on the housing. The operating mechanism has a latch arm pivotably mounted for movement relative to the housing between a latched position in which the latch arm is abuttable against a strike element and an unlatched position. The latch arm has a cam surface. The operating mechanism also has a lever pivotably mounted for movement relative to the housing between first and second operative positions. The lever has an edge which moves along the cam surface as the lever is moved from the second operative position to the first operative position to thereby move the latch arm from the unlatched position to the latched position.

The operating mechanism may further have a mechanism for releasably securing the lever in the first operative position. The mechanism for releasably securing the lever in the first operative position may have a detent in the cam surface, the edge of the lever being seated in the detent with the lever in the first operative position.

The operating mechanism may further have a handle pivotably mounted for movement relative to the housing in first and second directions. The handle abuts the lever as the handle is moved in the first direction to thereby unseat the edge from the detent. The handle also abuts the lever as the handle is moved in the second direction to thereby move the lever from the second operative position to the first operative position.

The housing may define a cup-shaped receptacle. The handle may be mounted in the cup-shaped receptacle and protrude from the cup-shaped receptacle with the latch arm in the unlatched position with the handle moved in the second direction to cause the latch arm to be placed in the unlatched position.

The latch may further have a mechanism for locking the handle to prevent movement of the handle relative to the housing in either the first or second directions. The mechanism for locking the handle may have a post projecting from the handle. The post may have a groove formed therein. The mechanism for locking the handle may also have a plate mounted on the housing and having a first edge moveable into the groove to prevent movement of the handle in either the first or second directions relative to the housing.

The operating mechanism may further have a mechanism cooperating between the latch arm and the housing for biasing the latch arm towards the unlatched position so that the latch arm moves from the latched position to the unlatched position as an incident of the lever moving out of the detent.

The latch arm may further have a hook abuttable against a strike element with the latch arm in the latched position.

The latch arm may also have an arm piece with a ridged surface, and the hook may have a ridged surface which is complementary to the ridged surface of the arm piece. The arm piece may be releasably securable to the hook with the ridged surface of the arm piece abutting the ridged surface of the hook to prevent relative movement between the hook and the arm piece.

According to another aspect of the present invention, a latch has a housing and an operating mechanism mounted on the housing. The operating mechanism has a latch arm pivotably mounted for movement relative to the housing between a latched position in which the latch arm is abuttable against a strike element and an unlatched position. The latch arm has a cam surface with a detent. The operating mechanism also has a lever pivotably mounted for movement relative to the housing between first and second operative positions. The lever has an edge which moves along the cam surface as the lever is moved from the second operative position to the first operative position to thereby move the latch arm from the unlatched position to the latched position, the edge being seated in the detent to maintain the latch arm in the latched position with the lever in the first operative position. The operating mechanism further has a handle pivotably mounted for movement relative to the housing in first and second directions. The handle abuts the lever as the handle is moved in the first direction such that the edge is unseated from the detent, and abuts the lever as the handle is moved in the second direction to thereby cause the edge to be moved from the second operative position to the first operative position.

The housing may define a cup-shaped receptacle. The handle may be mounted in the cup-shaped receptacle and protrude from the cup-shaped receptacle with the latch arm in the unlatched position with the handle moved in the second direction to cause the latch arm to be placed in the unlatched position.

The latch may further have a mechanism for locking the handle to prevent movement of the handle relative to the housing in either the first or second directions. The mechanism for locking the handle may have a post projecting from the handle. The post may have a groove formed therein. The mechanism for locking the handle may also have a plate mounted on the housing and having a first edge moveable into the groove to prevent movement of the handle in either the first or second directions relative to the housing.

The operating mechanism may further have a mechanism cooperating between the latch arm and the housing for biasing the latch arm towards the unlatched position so that the latch arm moves from the latched position to the unlatched position as an incident of the lever moving out of the detent.

The latch arm may further have a hook abuttable against a strike element with the latch arm in the latched position. The latch arm may also have an arm piece with a ridged surface, and the hook may have a ridged surface which is complementary to the ridged surface of the arm piece. The arm piece may be releasably securable to the hook with the ridged surface of the arm piece abutting the ridged surface of the hook to prevent relative movement between the hook and the arm piece.

DETAILED DESCRIPTION OF THE INVENTION

Figure 1:
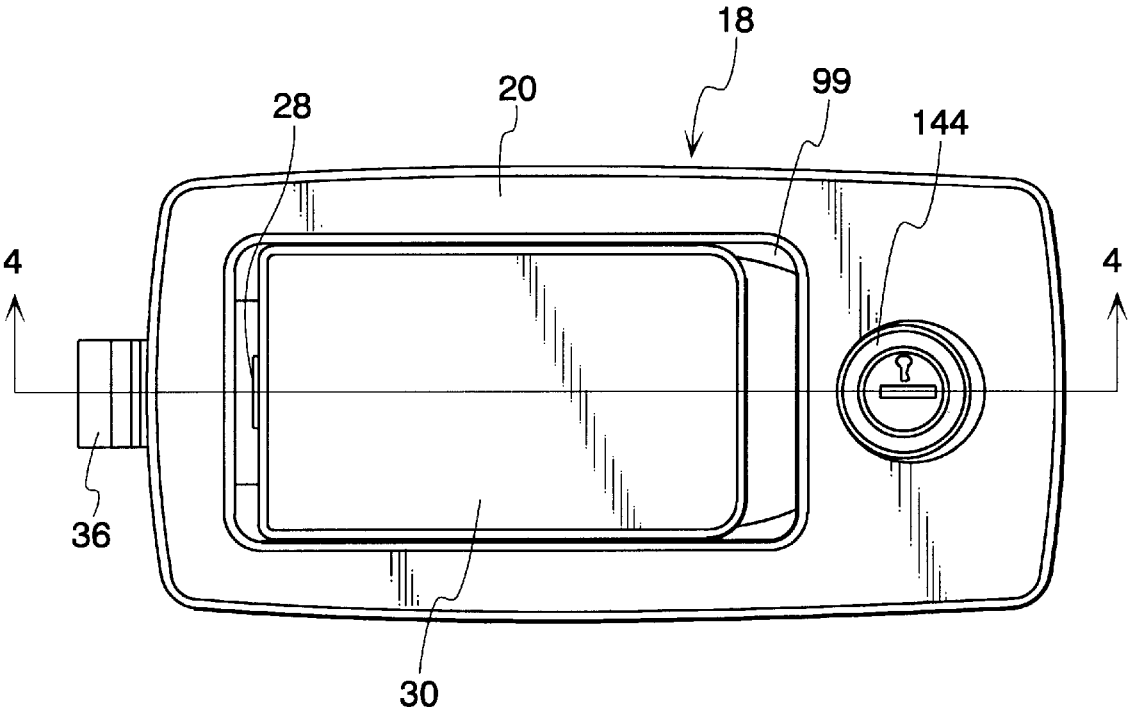
FIG. 1 is a front elevation view of an embodiment of a draw latch according to the present invention.

As seen in FIGS. 1, 2, 3, 4 and 5, a draw latch 18, according to the present invention, has a housing 20, an operating mechanism 22 mounted on the housing 20, and a locking mechanism 24 mounted on the housing to maintain the operating mechanism 22 in a latched state. The operating mechanism 22 has a latch arm 26, a lever 28 and a handle 30. The handle 30, lever 28 and latch arm 26 cooperate such that pivoting the handle 30 in a first direction around an axis 31 permits the latch arm 26 to move from a latched to an unlatched position. Similarly, pivoting the handle 30 in a second direction, opposite to the first direction, moves the latch arm 26 from the unlatched position to the latched position. The locking mechanism 24 preferably cooperates with the handle 30 to secure the handle 30, thereby maintaining the latch arm 26 in the latched position through the cooperation between the latch arm 26, lever 28 and the handle 30.

In a first embodiment of the present invention, shown in FIGS. 1–8, the latch arm 26 is itself an assembly of several pieces: a first arm piece 32, a second arm piece 34, a hook 36, a cam 38 and a fastener 40 that is preferably a self-cinching stud.

The first and second arm pieces 32, 34 have lower plates 44, 46, upper rods 48, 50 and joining shafts 52, 54. The lower plates 44, 46 are substantially rectangular in cross section (see FIG. 8), and extend substantially across the entire width of the housing 20 (see FIGS. 2 and 3). The lower plates 44, 46 each have a first flat or planar side 56, 58, a second ridged side 60, 62 and a hole 64, 66 formed therethrough. The upper rods 48, 50 are preferably of circular cross section until they insert into the cam 38, at which point they are of non-circular cross section (see FIGS. 2, 3, 4, 5 and 8). The upper rods 48, 50 extend approximately half way across the housing 20. The rods 48, 50 each have a substantially planar free end, of which only the end 68 of the rod 48 is showing in FIGS. 4, 5 and 8. The shafts 52, 54, which have a substantially rectangular cross section, extend between the lower plates 44,46 and the upper rods 48,50. The shaft 52 joins the plate 44 to the rod 48, while the shaft 54 joins the plate 46 to the rod 50.

The hook 36 has an angle 70 and a mounting plate 72. The angle 70 is shaped to abut a strike element 74 mounted on a door frame 75 (see FIG. 8). The mounting plate 72 has a ridged side 76 which corresponds to either the ridged side 60 of the left plate 44 or the ridged side 62 of the right plate 46. The mounting plate 72 has an elongate hole 78 formed therein.

The cam 38 extends preferably substantially less than the width of the housing 20, and has a hole 80 formed therethrough into which the rods 48, 50 of the first and second arm pieces 32, 34 extend when the latch arm 26 is assembled. The hole 80 preferably has a non-circular cross section which is complementary to the non-circular cross section of the rods 48, 50. The complementary, non-circular cross sections of the hole 80 and the rods 48, 50 key the cam 38 to the rods 48, 50 to allow the arm pieces 32, 34 and the cam 38 to move together as a single unit. The cam 38 also has a surface 82 with a detent 84.

To assemble the latch arm 26, the first and second pieces 32, 34 are disposed such that the flat sides 56, 58 abut and the rods 48, 50 extend through the holes 86, 88 in the housing 20 and the hole 80 in the cam 38. The hook 36 is then disposed with the ridged side 76 abutting, for example, the ridged side 60 of the left plate 44. The exact position of the angle 70 relative to the housing 20 can be adjusted by moving the ridged surface 76 relative to the ridged surface 60 in the direction of the arrow 90. This allows for fine adjustment of the sealing force of the latch 18 to accommodate variations with time. The arm pieces 32, 34 and the hook 36 are then secured together by placing the fastener 40 through the holes 64, 66 and 78.

Figure 8:
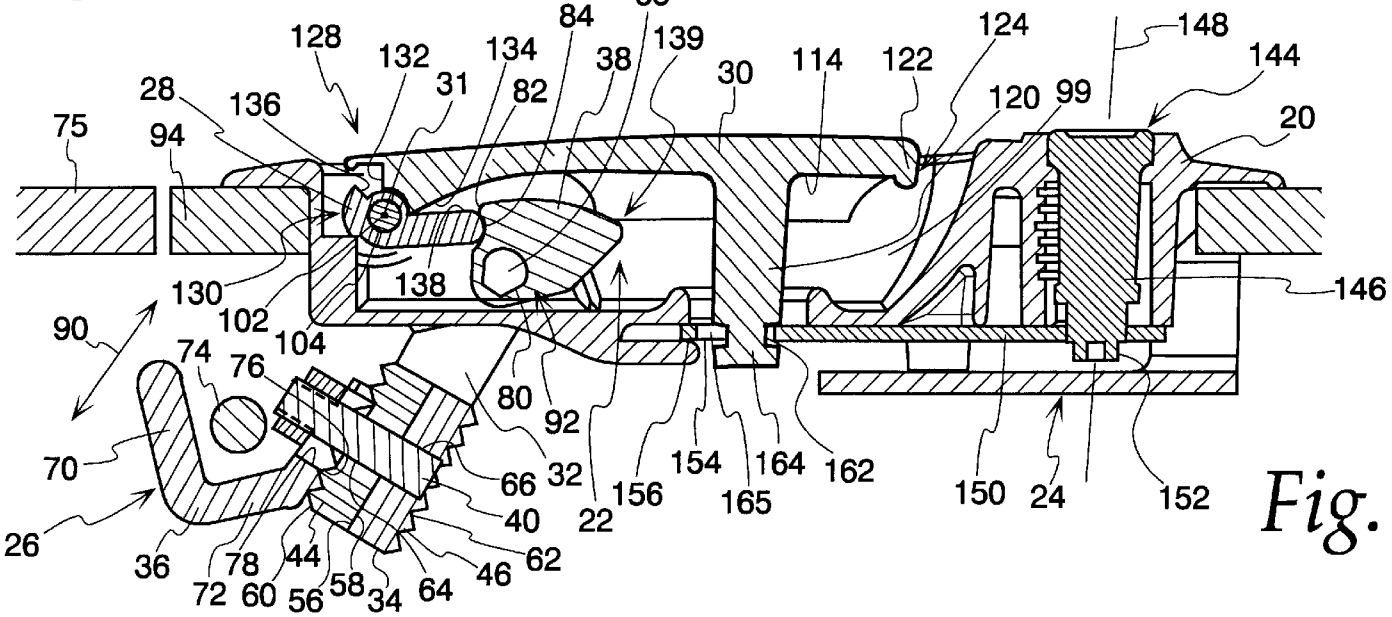
FIG. 8 is a cross-sectional view of the draw latch of FIG. 1 taken along line 4—4 and showing the latch in the latched position.
Figure 10:
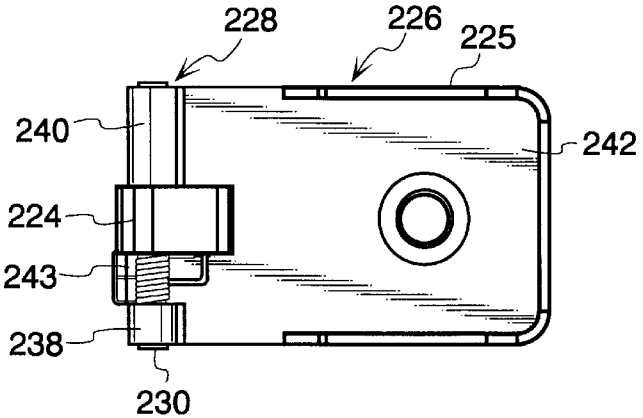
FIG. 10 is a reduced, plan view of the handle assembly of FIG. 9.
Figure 9:
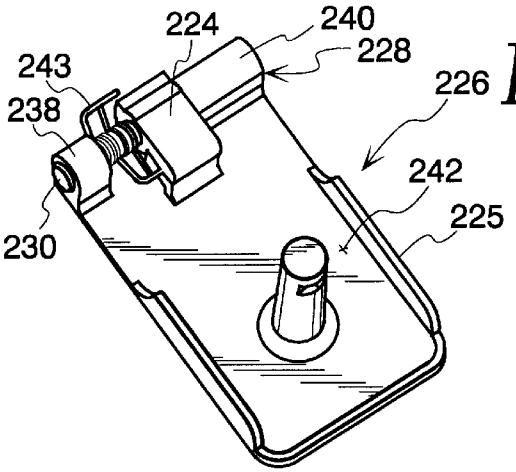
FIG. 9 is a view as in FIG. 6 showing a modified form of handle assembly on the draw latch according to the present invention.
Figure 11:
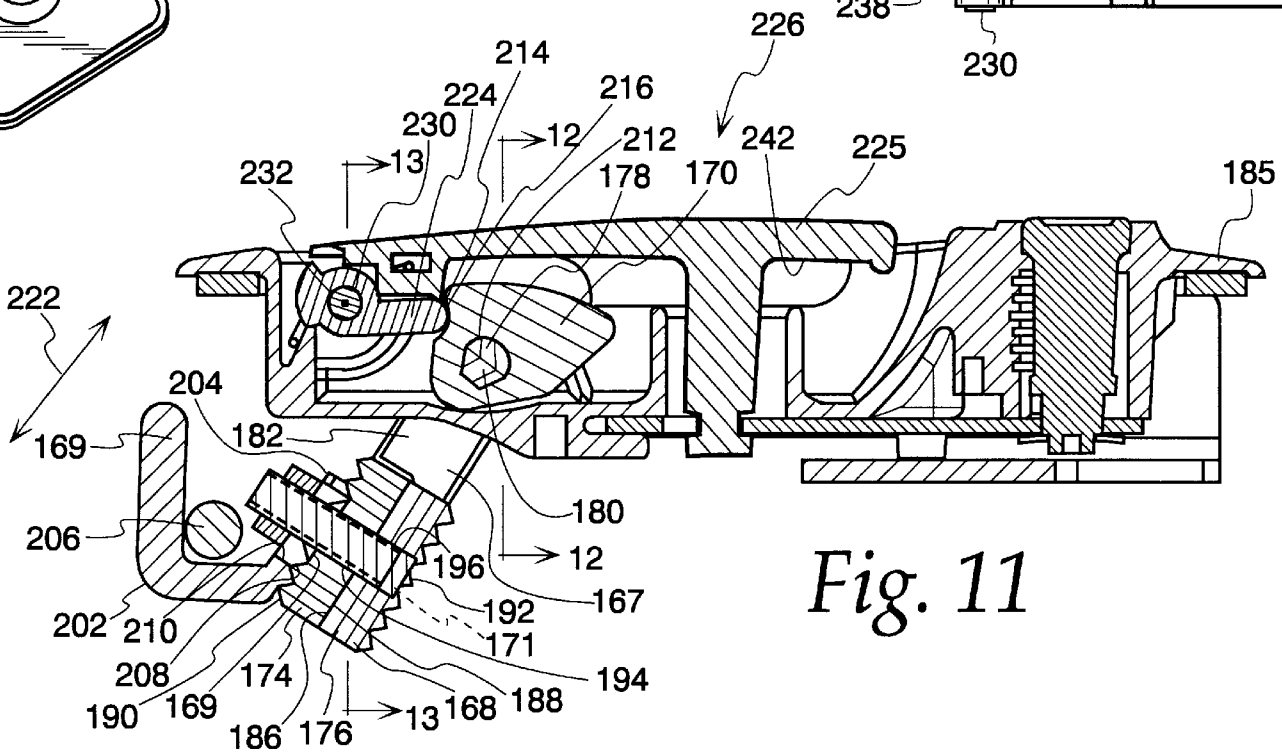
FIG. 11 is a cross-sectional view of another embodiment of a draw latch according to the present invention incorporating the handle assembly of FIG. 9 and showing the latch in a latched position.
Figure 12:
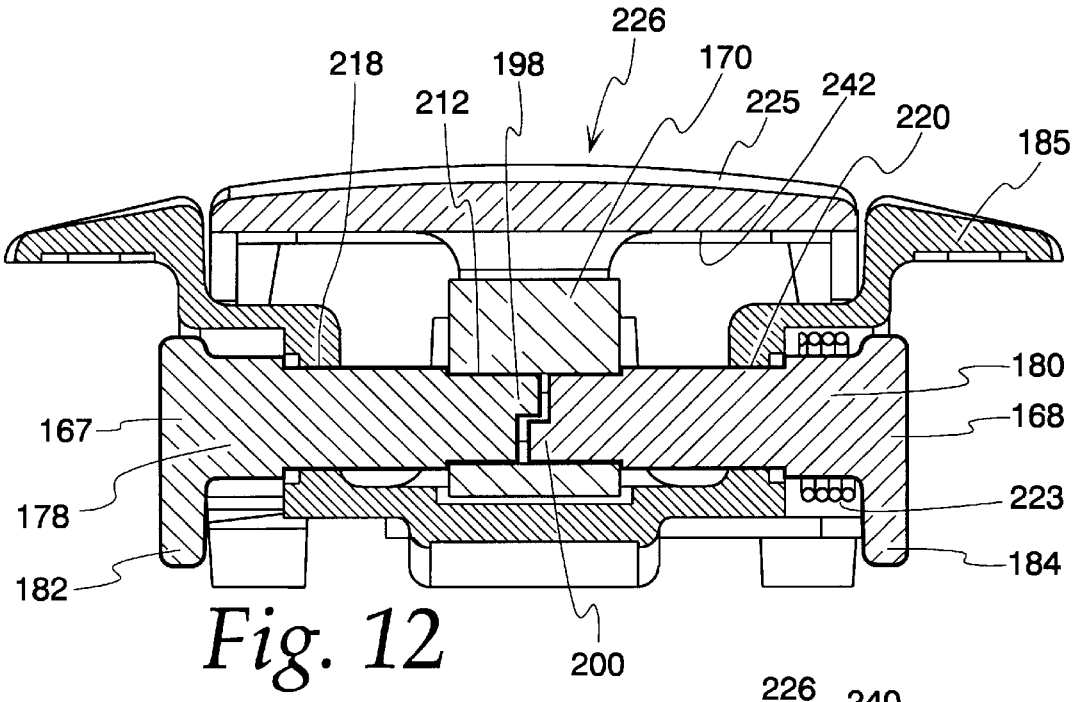
FIG. 12 is an enlarged cross-sectional view of the draw latch of FIG. 11 taken along line 12—12.
Figure 13:
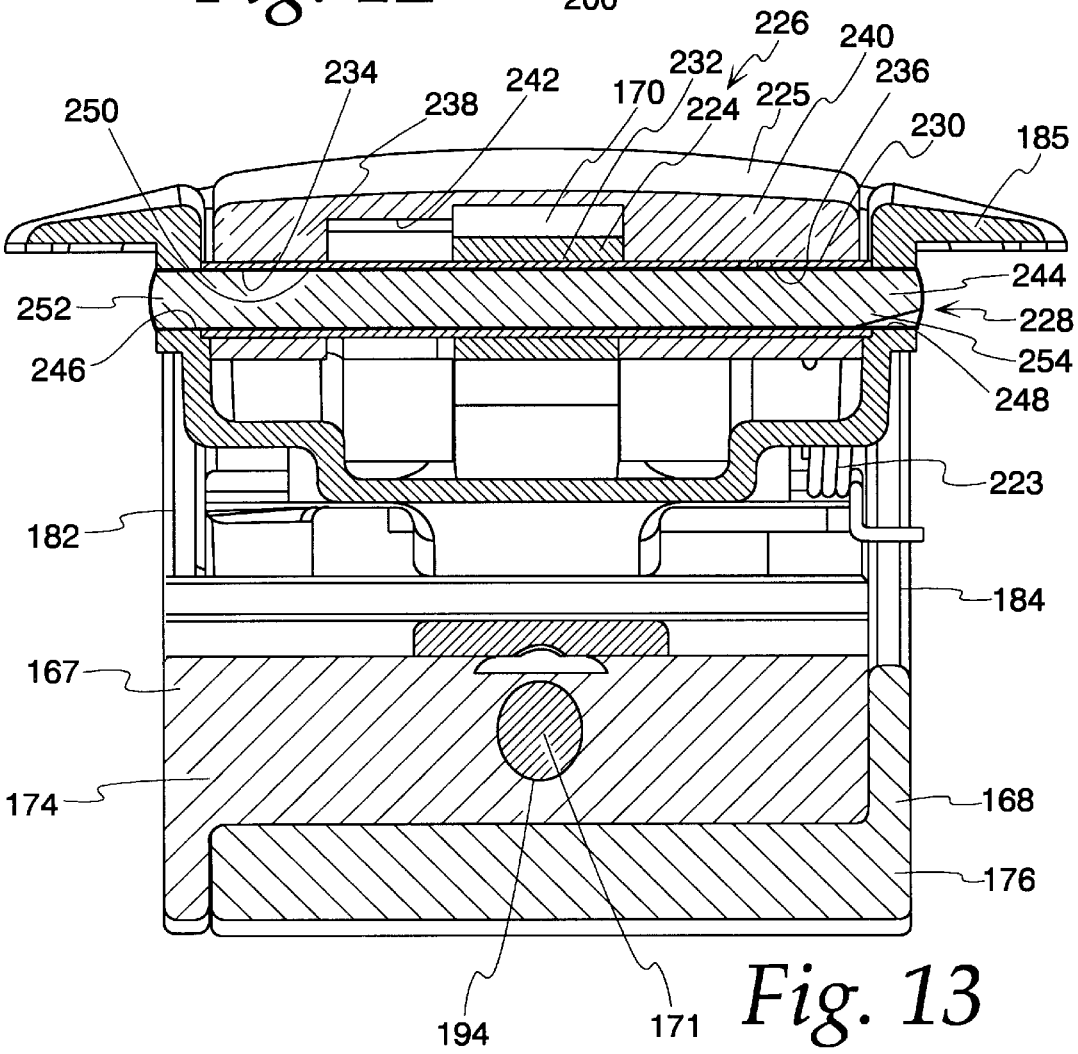
FIG. 13 is an enlarged cross-sectional view of the draw latch of FIG. 11 taken along line 13—13.
Figure 15:
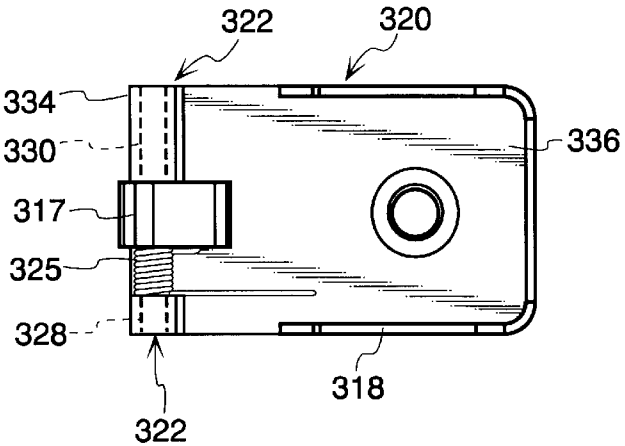
FIG. 15 is a reduced, plan view of the handle assembly of FIG. 14.
Figure 14:
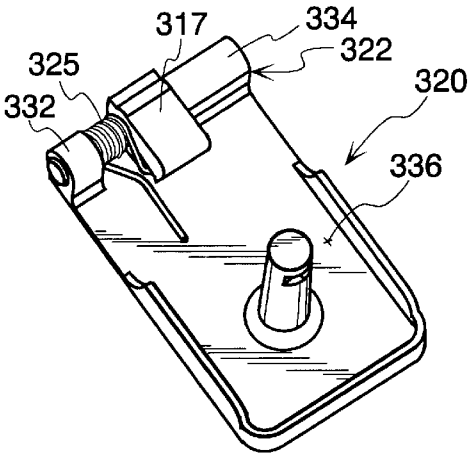
FIG. 14 is a view as in FIGS. 6 and 9 showing a further modified form of handle assembly on the draw latch according to the present invention.

A pivot 92 is formed by the rods 48, 50 and holes 86, 88 about which the latch arm 26 can pivot. The latch arm 26 can be moved from a first, latched position, such as is shown in FIG. 8, to a second, unlatched position, shown in FIG. 4. In the latched position, with the latch arm 26 abutting the strike element 74, a door 94 on which the latch 18 is mounted will be held secure to the strike element 74 in a fully closed position. In the unlatched position, the latch arm 26 is spaced from the strike element 74, such that the latch 18 is not secured to the strike element 74 so that the door 94 may be moved to a fully opened position. A biasing mechanism 96, such as a spring, is mounted on the rod 48 between the hole 86 and the shaft 52 of the second arm piece 32, and serves to bias the latch arm 26 towards the unlatched position.

The latch arm 26 is moved between its neutral, unlatched position and the latched position through the cooperation of the lever 28 and the handle 30 with the surface 82 of the cam 38 of the latch arm 26. Preferably, the lever 28 and the handle 30 are part of a handle assembly 98 which is mounted to the housing 20 on short cylindrical shafts (not shown) in a cup-shaped receptacle 99 defined by the housing 20.

Figure 7:
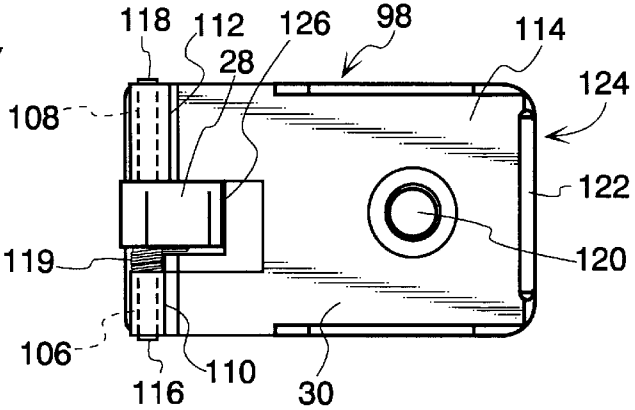
FIG. 7 is a reduced, plan view of the handle assembly of FIG. 6.
Figure 6:
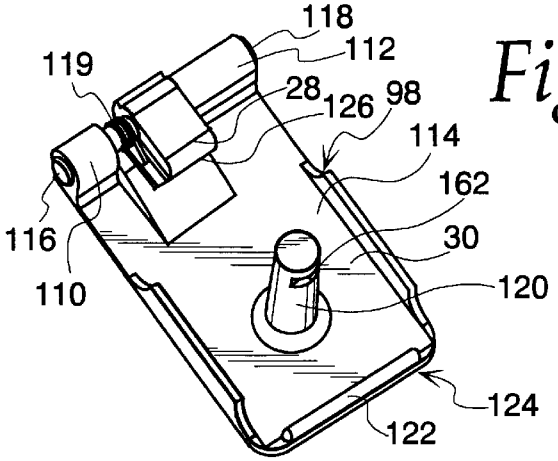
FIG. 6 is a reduced, perspective view of a handle assembly on the draw latch of FIG. 1.

The pivot axis 31 for the handle assembly 98 is defined by a pin 102 through a bore 104 formed in the lever 28 and a pair of bores 106, 108 formed in two pin mounts 110, 112 which extend from an interior side 114 of the handle 30 (see FIGS. 6 and 7). The pin 102 preferably does not extend entirely through the aligned bores 104, 106, 108, such that small cylindrical spaces (not shown) are provided in which bushings 116, 118 are disposed. The short cylindrical shafts (not shown) extending from the sides of the housing 20 fit within the bushings 116, 118 to pivotably secure the handle assembly 98 to the housing 20. The handle 30 is biased towards the housing 20 by a biasing mechanism 119, such as a spring, mounted on the pin 102.

Figure 2:
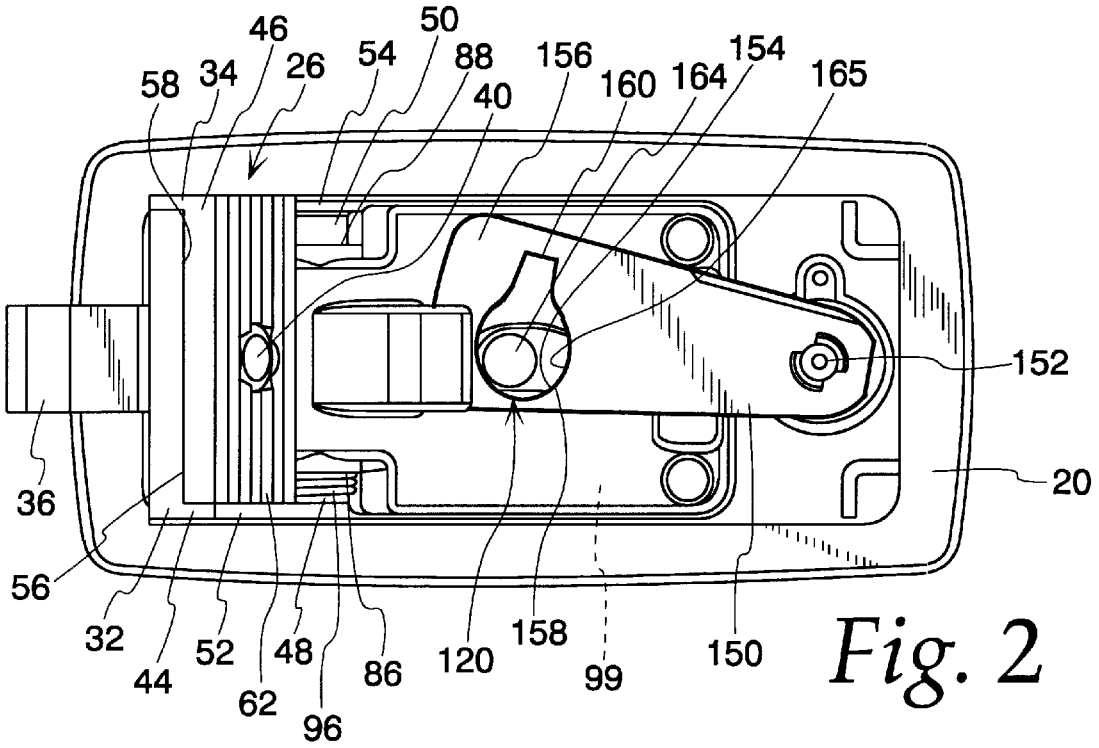
FIG. 2 is a rear elevation view of the draw latch of FIG. 1 with a locking mechanism in an unlocked position.
Figure 3:
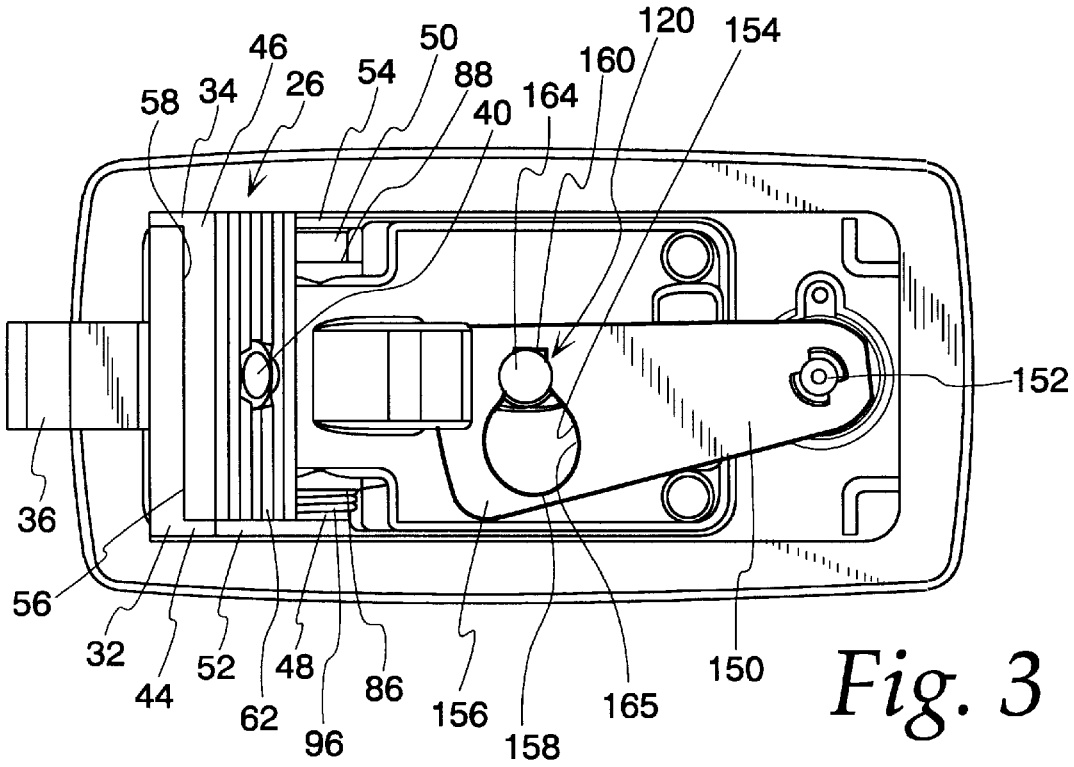
FIG. 3 is a view as in FIG. 2 with the locking mechanism in a locked position.
Figure 4:
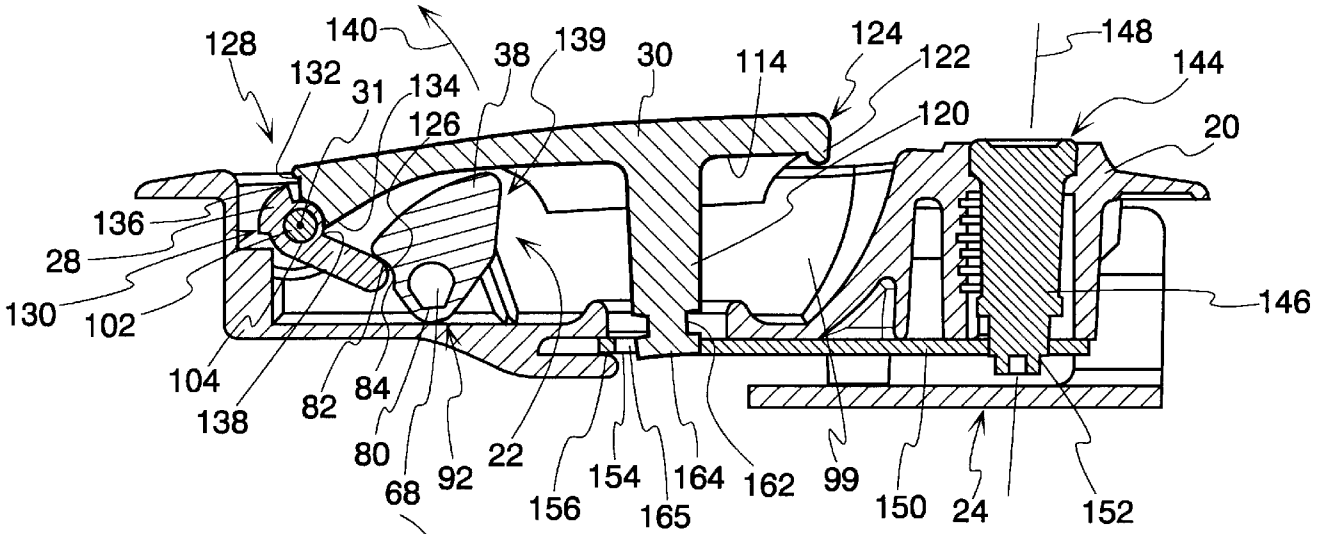
FIG. 4 is a cross-sectional view of the draw latch of FIG. 1 taken along line 4—4 and showing the latch in an unlatched position with the latch arm not shown.

The handle 30 is pivotable about the pivot axis 31 between an open position, such as is shown in FIGS. 2 and 4, and a closed position, such as shown in FIGS. 3 and 8. Protruding from the interior side 114 of the handle 30 is a cylindrical locking post 120, which cooperates with the locking mechanism 24 to lock the handle 30 in the closed position. Also extending from the interior side 114 of the handle 30 is a rim 122 to assist the user in gripping the edge 124 of the handle 30 to pivot the handle 30 about the pivot axis 31.

The lever 28 is also pivotable about the pivot axis 31 between first and second positions. In the first position, a follower edge 126 of the lever 28 is moveable along the surface 82 of the cam 38. In the second position, the follower edge 126 of the lever is seated in the detent 84 of the cam 82.

The handle 30 and the lever 28 cooperate through the interaction of two pairs of mated surfaces, one surface of each mated pair on the handle 30 and the other surface on the lever 28, formed on the ends 128, 130 of the handle 30 and lever 28 nearest the pivot axis 31. The handle 30 has a latching surface 132 and a delatching surface 134, while the lever 28 has a complementary latching surface 136 and a complementary delatching surface 138.

To secure the latch 18 to the strike element 74 and thereby maintain the door 94 in a closed state with the hook 36 abutting the strike element 74, the handle 30 is moved counterclockwise in the direction of the arrow 140 in FIG. 4 about the pivot axis 31, causing the latching surface 132 of the handle 30 to abut the latching surface 136 of the lever 28. Further movement of the handle 30 counterclockwise about the pivot axis 31 causes the lever 28 to move counterclockwise around the pivot axis 31. As the lever 28 moves about pivot axis 31, the follower edge 126 moves along the surface 82 of the cam 38, causing the cam 38 to move clockwise about the pivot 92. As the cam 38 moves clockwise, the angle 70 of the hook 36 is moved clockwise to abut the strike element 74. Further rotation of the handle 30 about the pivot axis 31 results in the hook 36 drawing the door 94 on which the latch 18 is mounted closer to the strike element 74 and the door frame 75 on which the strike element 74 is mounted, until the latch arm 26 reaches its fully latched position, as shown in FIG. 8. This causes the door 94 to be pulled against the door frame 75. In the fully latched position, the follower edge 126 of the lever 28 is seated within the detent 84 formed in the surface of the cam 38.

Figure 5:
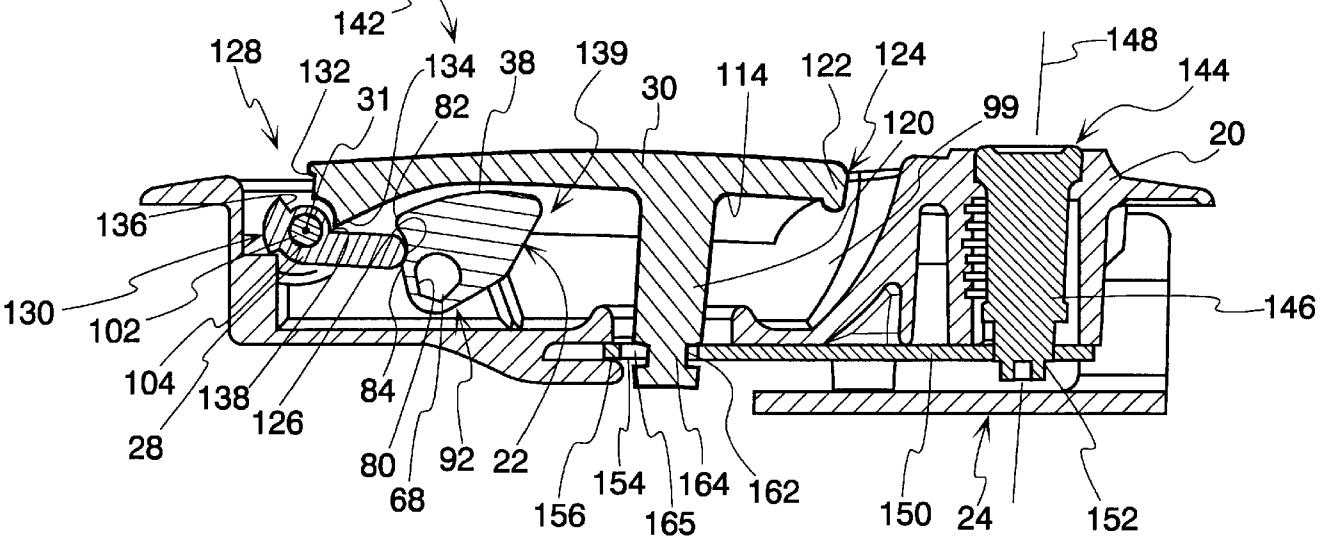
FIG. 5 is a cross-sectional view of the draw latch of FIG. 1 taken along line 4—4 and showing the latch in an intermediate position between a latched position and the unlatched position with the latch arm not shown.

Alternatively, the movement of the handle 30 clockwise in the direction of arrow 142 about the pivot axis 31 causes the delatching surface 134 of the handle 30 to abut the delatching surface 138 of the lever 28, as shown in FIG. 5. Further movement of the handle 30 clockwise causes the lever 28 to move clockwise. Consequently, the follower edge 126 of the lever 28 moves out of the detent 84. The unseating of the follower edge 126 from the detent 84 allows the cam 38, which is biased counterclockwise by the biasing mechanism 96, to move freely, rotating the latch arm 26 counterclockwise away from the strike element 74. As a consequence, the latch arm 26 reaches its fully unlatched position and the door 94 can be moved away from the strike element 74.

As mentioned previously, the latch 18 also has the locking mechanism 24, which cooperates with the locking post 120 to lock the latch arm 26 in the latched position. In particular, the locking mechanism 24 preferably has a cylinder lock 144 which has a plug 146 which rotates about an axis 148. A triangularly-shaped locking plate 150 is attached to an interior end 152 of the plug 146 for rotation therewith about the axis 148. A cutout 154 is formed in the plate 150 at an end 156 of the locking plate 150 opposite the plug 146. The cutout 154 is of an irregular shape, having a first oval-shaped section 158 and a second square-shaped section 160.

The locking post 120 has a groove 162 formed on an innermost end 164 thereof. With the handle in the closed position, such as shown in FIG. 8, the groove 162 is aligned with the edge 165 of the cutout 154 of the plate 150. By rotating the plate 150 from the position shown in FIG. 2 to the position shown in FIG. 3, the edge 165 of the cutout 154 moves into the grove 162 of the locking post 120, thereby maintaining the handle 30 in the closed position. By rotating the plate 150 from the position shown in FIG. 3 to that shown in FIG. 2, the handle 30 may be moved either counterclockwise or clockwise to either latch or delatch the latching arm 26.

Thus, to summarize the operation of the latch 18 from the fully latched and locked position, shown in FIGS. 3 and 8, to the fully open and unlocked position, shown in FIG. 4, a key (not shown) is inserted into the lock 144, and rotated about the axis 148. This rotation about axis 148 causes the plug 146 and the plate 150 to move about axis 148, moving the plate 150 from the position shown in FIG. 3 to that shown in FIG. 2. This causes the edge 165 of the plate 150 to move out of engagement with the groove 162 in the end 164 of the locking post 120.

With the edge 165 moved out of engagement with the groove 162, the handle 30 can be moved about the pivot axis 31 in the clockwise direction, as shown in FIG. 5. The movement of the handle 30 in the clockwise direction causes the delatching surface 134 of the handle 30 to abut the delatching surface 138 of the lever 28, thereby causing the lever 28 to rotate in a clockwise direction about the pivot axis 31.

Movement of the lever 28 in the clockwise direction causes the follower edge 126 of the lever 28 to move out of the detent 84 in the surface 82 of the cam 38. This allows the latch arm 26, which is biased counterclockwise by the biasing mechanism 96, to move counterclockwise. Movement of the latch arm 26 counterclockwise causes the latch arm 26 to move away from the strike element 74, such that the door 94 may be moved into its fully open position.

Once the latch arm 26 moves to its unlatched position, an edge 139 of the cam 38 abuts the interior surface 114 of the handle 30, causing the handle 30 to protrude somewhat from the cup-shaped receptacle 99. The protrusion of the handle 30 from the receptacle 99 provides a visual indication that the latch arm 26 is unlatched. Because the handle 30 only protrudes slightly from the receptacle 99, however, the handle 30 is much less likely to cause damage when the door 94 on which the latch 18 is mounted is moved to its fully open position.

With the strike element 74 released from the latch arm 26, but with the door 94 positioned so that the hook 36 is in close proximity to the strike element 74, the handle 30 may be moved in a counterclockwise direction to secure the door 94 to the strike element 74. In particular, movement of the handle 30 in the counterclockwise direction causes the latching surface 132 of the handle 30 to abut the latching surface 136 of the lever 28. Further counterclockwise movement causes the lever 28 to move counterclockwise, moving the follower edge 126 of the lever 28 along the surface 82 of the cam 38, causing the cam 38 to move clockwise.

As the cam 38 moves clockwise, the latch arm 26 is rotated about the pivot 92 in the direction of the strike element 74. Further clockwise movement causes the strike element 74 and the hook 36 of the latch arm 26 to cooperate to pull the door 94 into the fully closed position, with the latch 18 abutting the strike element 74. The operating mechanism 22 reaches its fully latched position when the follower edge 126 is seated in the detent 84.

With the latch arm 26 in the fully latched position, the key (not shown) can be used to rotate the plug 146 of the lock 144 about the axis 148, thereby rotating the locking plate 150 such that the edge 165 of the plate 150 fits within and engages the groove 162 in the locking post 120 of the handle 30. With the handle 30 so locked, the latch 18 is locked with the latch arm 26 in the latched position.

A second embodiment of the present invention is shown in FIGS. 9–13. While the operation is similar to that of the first embodiment discussed above, the assembly of the second embodiment requires further explanation.

The latch arm 166 of the second embodiment is an assembly of several pieces: a first arm piece 167, a second arm piece 168, a hook 169, a cam 170 and a fastener 171 that is preferably a self-cinching stud.

The first and second arm pieces 167, 168 have lower plates 174, 176, upper rods 178, 180 and joining shafts 182, 184. The lower plates 174, 176 are substantially rectangular in cross section (see FIG. 11), and extend substantially across the entire width of the housing 185 (see FIG. 13). The lower plates 174, 176 each have a first flat or planar side 186, 188, a second ridged side 190, 192 and a hole 194, 196 formed therethrough. The upper rods 178, 180 are preferably of circular cross section until they insert into the cam 170, at which point they are of non-circular cross section (see FIG. 11). The upper rods 178, 180 extend approximately half way across the housing 20. The rods 178, 180 have stepped ends 198, 200 which mate to limit the relative angular movement between the rods 178, 180. The shafts 182, 184 have a rectangular cross section and extend between the lower plates 174, 176 and the upper rods 178, 180. The shaft 182 joins the plate 174 to the rod 178, while the shaft 184 joins the plate 176 to the rod 180.

The hook 169 has an angle 202 and a mounting plate 204. The angle 202 is shaped to abut a strike element 206 (see FIG. 11). The mounting plate 204 has a ridged side 208 which corresponds to either the ridged side 190 of the left plate 167 or the ridged side 192 of the right plate 168. The mounting plate 204 has an elongate hole 210 formed therein.

The cam 170 extends less than the width of the housing 20, and has a hole 212 formed therethrough into the rods 178, 180 of the first and second arm pieces 167, 168 extend. The hole 212 preferably has a non-circular cross section which is complementary to the non-circular cross section of rods 178, 180. The complementary, non-circular cross sections of the hole 212 and the rods 178, 180 key the cam 170 to the rods 178, 180 to allow the arm pieces 167, 168 and the cam 170 to move together as a single unit. The cam 170 also has a surface 214 with a detent 216.

To assemble the latch arm 166, the first and second pieces 167, 168 are disposed such that the flat sides 186, 188 abut and the rods 178, 180 extend through holes 218, 220 in the housing 185 and the hole 212 in the cam 170. The hook 169 is then disposed with the ridged side 208 abutting, for example, the ridged side 190 of the left plate 167. The exact position of the angle 202 relative to the housing 185 can be adjusted by moving the ridged surface 208 relative to the ridged surface 190 in the direction of the arrow 222. The arm pieces 167, 168 and the hook 169 are then secured together by placing the fastener 171 through the holes 194, 196 and 210. A biasing mechanism 223, such as a spring, is mounted on the rod 180 between the hole 220 and the shaft 184 of the second arm piece 168, and serves to bias the latch arm 166 counterclockwise (as viewed in FIG. 11).

The latch arm 166 is moved through the cooperation of the lever 224 and the handle 225 with the surface 214 of the cam 170 of the latch arm 166. Preferably, the lever 224 and the handle 225 are part of a handle assembly 226 which is mounted to the housing 185 as is explained below.

The handle assembly 226 has a common pivot 228. The pivot 228 is formed by passing a tube 230 through a bore 232 formed in the lever 224 and a pair of bores 234, 236 formed in two tube mounts 238, 240 which extend from an interior side 242 of the handle 225 (see FIG. 11). The tube 230 preferably extends entirely through the aligned bores 232, 234, 236. A biasing mechanism 231, for example a spring, is mounted on the tube 230 to bias the handle 225 towards the housing 185. A pin 244 is passed through holes 246, 248 in the housing 185 and a passage 250 of the tube 230, so that the ends 252, 254 of the pin 244 extend from the sides of the housing 185.

A third embodiment of the present invention is shown in FIGS. 14–17. While the operation is similar to that of the first and second embodiments discussed above, the assembly of the third embodiment requires further explanation.

The latch arm 256 also is an assembly of several pieces: a first arm piece 258, a second arm piece 260, a hook 262, a cam 264 and a fastener 266 that is preferably a self-cinching stud.

Figure 16:
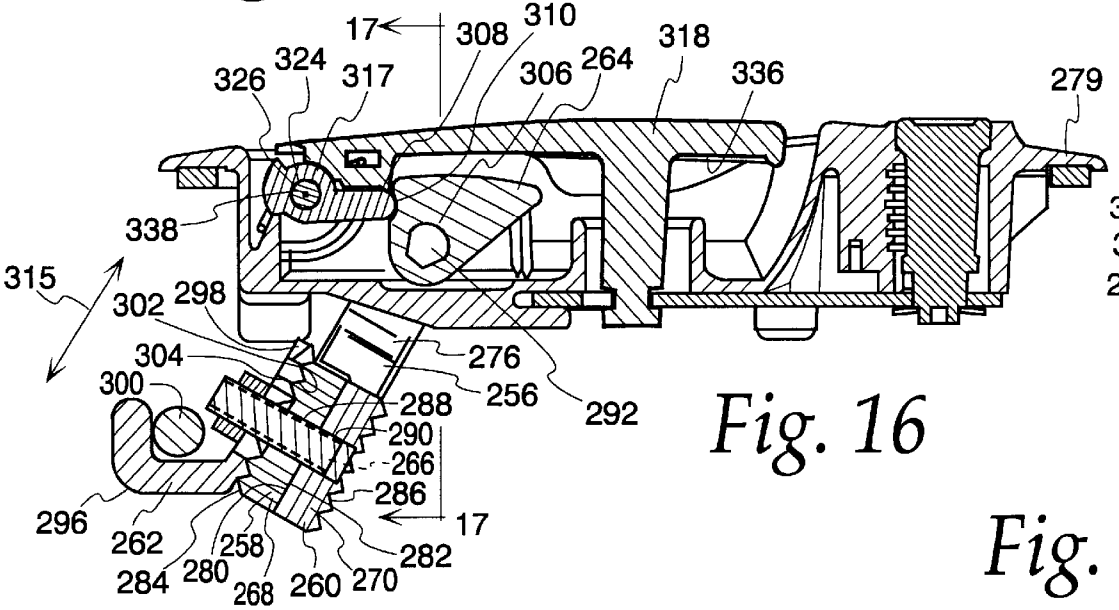
FIG. 16 is a cross-sectional view of another embodiment of a draw latch according to the present invention incorporating the handle assembly of FIG. 9 and showing the latch in a latched position.
Figure 17:
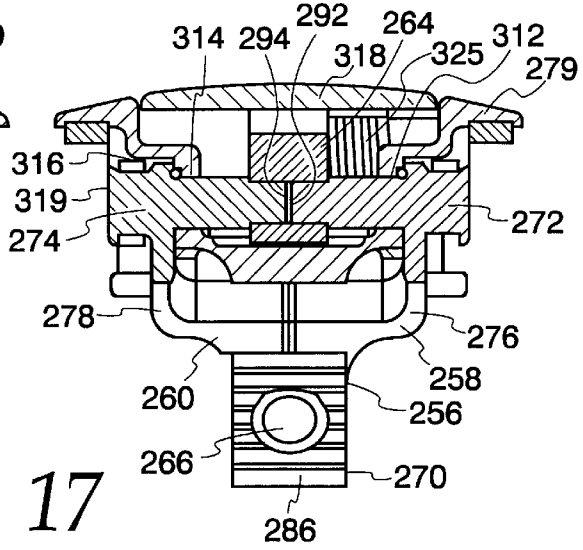
FIG. 17 is a cross-sectional view of the draw latch of FIG. 16 taken along line 17—17.

The first and second arm pieces 258, 260 have lower plates 268, 270, upper rods 272, 274 and L-shaped joining shafts 276, 278. The lower plates 268, 270 are substantially rectangular in cross section (see FIG. 16), and extend preferably across less than the entire width of the housing 279 as shown in FIG. 17. The lower plates 268, 270 each have a first flat or planar side 280, 282, a second ridged side 284, 286 and a hole 288, 290 formed therethrough. The upper rods 272, 274 are preferably of circular cross section until they insert into the cam 264, at which point they are of non-circular cross section (see FIG. 16). The upper rods 272, 274 extend half way across the housing 279. The rods 272, 274 have substantially planar ends 292, 294, as shown in FIG. 17. The shafts 276, 278 extend between the lower plates 268, 270 and the upper rods 272, 274. The shaft 276 joins plate 268 to rod 272, while the shaft 278 joins the plate 270 to the rod 274.

The hook 262 has an angle 296 and a mounting plate 298. The angle 296 is shaped to abut a strike element 300 (FIG. 16). The mounting plate 298 has a ridged side 302 which corresponds to either the ridged side 284 of the left plate 258 or the ridged side 286 of the right plate 260. The mounting plate 298 has an elongate hole 304 formed therein.

The cam 264 extends less than the width of the housing 279, and has a hole 306 formed therethrough into which the rods 272, 274 of the first and second arm pieces 258, 260 extend. The hole 306 preferably has a non-circular cross section which is complementary to the non-circular cross section of rods 272, 274. The complementary, non-circular cross sections of the hole 306 and the rods 272, 274 key the cam 264 to the rods 272, 274 to allow the arm pieces 258, 260 and the cam 264 to move together as a single unit. The cam 264 also has a surface 308 including a detent 310.

To assemble the latch arm 256, the first and second pieces 258,260 are disposed such that the flat sides 280, 282 abut and the rods 272, 274 extend through holes 312, 314 in the housing 279 and the hole 306 in the cam 264. The hook 262 is then disposed with the ridged side 302 abutting, for example, the ridged side 284 of the left-hand plate 258. The exact position of the angle 296 relative to the housing 279 can be adjusted by moving the ridged surface 302 relative to the ridged surface 284 in the direction of the arrow 315. The arm pieces 258, 260 and the hook 262 are then secured together by placing the fastener 266 through the holes 288, 290 and 304. A biasing mechanism 316, such as a spring, is mounted on an extension 319 of the rod 274 of the second arm piece 168, and serves to bias the latch arm 256 counterclockwise (as viewed in FIG. 16).

The latch arm 256 is moved through the cooperation of the lever 317 and the handle 318 with the surface 308 of the cam 264 of the latch arm 256. Preferably, the lever 317 and the handle 318 are part of a handle assembly 320 which is mounted to the housing 279 as is explained below.

The handle assembly 320 has a common pivot 322. The pivot 322 is formed by passing a tube 324 through a bore 326 formed in the lever 317 and a pair of bores 328, 330 formed in two tube mounts 332, 334 which extend from an interior side 336 of the handle 318 (see FIGS. 14 and 15). The tube 324 preferably extends entirely through the aligned bores 326, 328, 330. A biasing mechanism 325, for example a spring, is mounted on the tube 324 to bias the handle 318 towards the housing 279. A pin 338 is passed through holes (not shown) in the housing 279 and a passage 340 of the tube 324, so that the ends (not shown) of the pin 338 extend from the sides of the housing 279.

The latch described above may have a number of advantages. First, the latch may reduce the chance of damage to the associated strike element and vehicle by providing a handle which is substantially flush with the housing and a latch arm which is moved away from contact with the strike element when the latch is in the unlatched position. Second, by providing a slight protrusion of the handle from the housing in the unlatched position, the latch may provide a visual indication that the latch is unlatched. Third, the latch may provide a mechanical advantage in generating the force necessary to secure the door to the strike element. Fourth, by providing a mechanism for fine adjustment of the position of the hook relative to the housing, the latch may reduce the amount of time spent correcting variations of the force needed to secure the door on which the latch is mounted to the strike element which may occur over time.

Still other aspects, objects, and advantages of the present invention can be obtained from a study of the specification, the drawings, and the appended claims.

We claim:

1. A latch comprising:

a housing defining a cup-shaped receptacle opening in a forward direction; and an operating mechanism mounted on the housing and comprising a) a latch arm pivotably mounted for movement relative to the housing between a latched position in which the latch arm is abuttable against a strike element and an unlatched position, the latch arm having a cam surface; b) a lever mounted for movement relative to the housing between first and second operative positions, the lever having an edge which moves against the cam surface as the lever is moved from the second operative position to the first operative position to thereby move the latch arm from the unlatched position to the latched position; and c) a handle mounted for movement relative to the housing in first and second opposite directions, said handle having a hand-graspable portion that can be repositioned by drawing the hand-graspable portion in a forward direction to thereby move the handle in the first direction, the handle causing the lever to move from the second operative position towards the first operative position as the handle moves in the first direction.

2. The latch according to claim 1 wherein the handle is mounted for pivoting movement relative to the housing around a first axis.

3. The latch according to claim 1 wherein the lever is movable relative to the handle.

4. The latch according to claim 1 wherein the handle has a closed position wherein a substantial portion of the handle resides within the receptacle and an open position wherein more of the handle resides outside of the receptacle than with the handle in the closed position.

5. The latch according to claim 4 wherein the graspable portion of the handle projects forwardly from the receptacle with the handle in the open position.

6. The latch according to claim 4 wherein there is a spring that biases the latch arm towards the unlatched position.

7. The latch according to claim 6 wherein the handle is moved by the latch arm from the closed position into the open position as the latch arm moves from the latched position into the unlatched position.

8. The latch according to claim 4 wherein the cam surface and lever reside within the receptacle.

9. The latch according to claim 1 further comprising a lock mechanism that is placeable selectively in first and second states, the lock mechanism in the first state preventing the handle from moving in the first direction so as to cause the lever to move from the second operative position into the first operative position.

10. A latch comprising:

a housing defining a cup-shaped receptacle opening in a forward direction; and an operating mechanism mounted on the housing and comprising a) a latch arm mounted for movement relative to the housing between a latched position in which the latch arm is abuttable against a strike element and an unlatched position, the latch arm having a cam surface; b) a lever mounted for movement relative to the housing between first and second operative positions, the lever having an edge which moves against the cam surface as the lever is moved from the second operative position to the first operative position to thereby move the latch arm from the unlatched position to the latched position; and c) a handle mounted for movement relative to the housing in first and second opposite directions, said handle having a hand-graspable portion that can be repositioned by drawing the hand-graspable portion in a forward direction to thereby move the handle in the first direction, the handle causing the lever to move from the second operative position towards the first operative position as the handle moves in the first direction, wherein there is a detent in the cam surface, the edge of the lever being seated in the detent with the lever in the first operative position.

11. A latch comprising:

a housing defining a cup-shaped receptacle opening in a forward direction;

an operating mechanism mounted on the housing and comprising a) a latch arm mounted for movement relative to the housing between a latched position in which the latch arm is abuttable against a strike element and an unlatched position, the latch arm having a cam surface; b) a lever mounted for movement relative to the housing between first and second operative positions, the lever having an edge which moves against the cam surface as the lever is moved from the second operative position to the first operative position to thereby move the latch arm from the unlatched position to the latched position; and c) a handle mounted for movement relative to the housing in first and second opposite directions, said handle having a hand-graspable portion that can be repositioned by drawing the hand-graspable portion in a forward direction to thereby move the handle in the first direction, the handle causing the lever to move from the second operative position towards the first operative position as the handle moves in the first direction; and a lock mechanism that is placeable selectively in first and second states, the lock mechanism in the first state preventing the handle from moving in the first direction so as to cause the lever to move from the second operative position into the first operative position, wherein the lock mechanism comprises a post projecting from the handle and having a groove formed therein, and a plate mounted on the housing and having a first edge moveable into the groove to prevent movement of the handle in either the first or second directions relative to the housing with the lock mechanism in the first state.

12. A latch comprising:

a housing defining a cup-shaped receptacle opening in a forward direction; and an operating mechanism mounted on the housing and comprising a) a latch arm mounted for movement relative to the housing between a latched position in which the latch arm is abuttable against a strike element and an unlatched position, the latch arm having a cam surface; b) a lever mounted for movement relative to the housing between first and second operative positions, the lever having an edge which moves against the cam surface as the lever is moved from the second operative position to the first operative position to thereby move the latch arm from the unlatched position to the latched position; and c) a handle mounted for movement relative to the housing in first and second opposite directions, said handle having a hand-graspable portion that can be repositioned by drawing the hand-graspable portion in a forward direction to thereby move the handle in the first direction, the handle causing the lever to move from the second operative position towards the first operative position as the handle moves in the first direction, wherein the latch arm further comprises a hook abuttable against a strike element with the latch arm in the latched position.

13. The latch according to claim 12, wherein:

the latch arm further comprises an arm piece with a ridged surface, the hook has a ridged surface which is complementary to the ridged surface of the arm piece; and the arm piece is releasably securable to the hook with the ridged surface of the arm piece abutting the ridged surface of the hook to prevent relative movement between the hook and the arm piece.

14. A latch comprising:

a housing having a front, that is exposed with the latch mounted operatively to a closure element, and a rear; and an operating mechanism on the housing and comprising a) a latch arm mounted for movement relative to the housing between a latched position in which the latch arm is abuttable against a strike element and an unlatched position; b) a lever mounted for movement relative to the housing between first and second operative positions, the lever causing the latch arm to move from the unlatched position towards the latched position as the lever moves from the second operative position into the first operative position; and c) a handle mounted for movement relative to the housing in first and second opposite directions, the handle having a hand-graspable portion that can be repositioned by drawing the hand-graspable portion in a forward direction to thereby move the handle in the first direction, the handle causing the lever to move from the second operative position towards the first operative position as the handle moves in the first direction, and a lock mechanism that is placeable selectively in first and second states, the lock mechanism in the first state preventing the handle from moving in the first direction so as to cause the lever to move from the second operative position into the first operative position, wherein the means for locking the handle comprises a post projecting from the handle and having a groove formed therein and a plate mounted on the housing and having a first edge moveable into the groove to prevent movement of the handle in either the first or second directions relative to the housing.

15. A latch comprising:

a housing having a front, that is exposed with the latch mounted operatively to a closure element, and a rear; and an operating mechanism on the housing and comprising a) a latch arm mounted for movement relative to the housing between a latched position in which the latch arm is abuttable against a strike element and an unlatched position; b) a lever mounted for movement relative to the housing between first and second operative positions, the lever causing the latch arm to move from the unlatched position towards the latched position as the lever moves from the second operative position into the first operative position; and c) a handle mounted for movement relative to the housing in first and second opposite directions, the handle having a hand-graspable portion that can be repositioned by drawing the hand-graspable portion in a forward direction to thereby move the handle in the first direction, the handle causing the lever to move from the second operative position towards the first operative position as the handle moves in the first direction, wherein the latch arm further comprises a hook abuttable against a strike element with the latch arm in the latched position.

16. A latch comprising:

a housing; and an operating mechanism mounted on the housing and comprising a) a latch arm pivotably mounted for movement relative to the housing, between a latched position in which the latch arm is abuttable against a strike element and an unlatched position, the latch arm having a cam surface with a detent, b) a lever pivotably mounted for movement relative to the housing between first and second operative positions, the lever having an edge which moves along the cam surface as the lever is moved from the second operative position to the first operative position to thereby move the latch arm from the unlatched position to the latched position, the edge being seated in the detent to maintain the latch arm in the latched position with the lever in the first operative position, and c) a handle pivotably mounted for movement relative to the housing in first and second directions, the handle abutting the lever as the handle is moved in the first direction such that the edge is unseated from the detent, and the handle abutting the lever as the handle is moved in the second direction to thereby cause the edge to be moved from the second operative position to the first operative position, wherein the latch arm further comprises a hook abuttable against a strike element with the latch arm in the latched position, wherein the latch arm further comprises an arm piece with a ridged surface, the hook has a ridged surface which is complementary to the ridged surface of the arm piece, and the arm piece is releasably securable to the hook with the ridged surface of the arm piece abutting the ridged surface of the hook to prevent relative movement between the hook and the arm piece.

17. A latch comprising:

a housing defining a cup-shaped receptacle opening in a forward direction; and an operating mechanism mounted on the housing and comprising a) a latch arm mounted for movement relative to the housing between a latched position in which the latch arm is abuttable against a strike element and an unlatched position, the latch arm having a cam surface; b) a, lever mounted for movement relative to the housing between first and second operative positions, the lever having an edge which moves against the cam surface as the lever is moved from the second operative position to the first operative position to thereby move the latch arm from the unlatched position to the latched position; and c) a handle mounted for movement relative to the housing in first and second opposite directions, said handle having a hand-graspable portion that can be repositioned by drawing the hand-graspable portion in a forward direction to thereby move the handle in the first direction, the handle causing the lever to move from the second operative position towards the first operative position as the handle moves in the first direction, wherein the latch arm is pivotably mounted for movement between the latched and unlatched positions, wherein the handle is mounted for pivoting movement relative to the housing around a first axis, wherein the lever is pivotable relative to the housing and the handle around the first axis.

18. A latch comprising:

a housing defining a cup-shaped receptacle opening in a forward direction; and an operating mechanism mounted on the housing and comprising a) a latch arm mounted for movement relative to the housing between a latched position in which the latch arm is abuttable against a strike element and an unlatched position, the latch arm having a cam surface; b) a lever mounted for movement relative to the housing between first and second operative positions, the lever having an edge which moves against the cam surface as the lever is moved from the second operative position to the first operative position to thereby move the latch arm from the unlatched position to the latched position; and c) a handle mounted for movement relative to the housing in first and second opposite directions, said handle having a hand-graspable portion that can be repositioned by drawing the hand-graspable portion in a forward direction to thereby move the handle in the first direction, the handle causing the lever to move from the second operative position towards the first operative position as the handle moves in the first direction, wherein there is a detent in the cam surface, the edge of the lever being seated in the detent with the lever in the first operative position, wherein the handle has a surface which drives the edge of the lever out of the detent and moves the lever from the first operative position into the second operative position to permit the latch arm to move from the latched position into the unlatched position as the handle is moved in the second direction.

19. A latch comprising:

a housing having a front, that is exposed with the latch mounted operatively to a closure element, and a rear;

an operating mechanism on the housing and comprising a) a latch arm mounted for movement relative to the housing between a latched position in which the latch arm is abuttable against a strike element and an unlatched position; b) a lever mounted for movement relative to the housing between first and second operative positions, the lever causing the latch arm to move from the unlatched position towards the latched position as the lever moves from the second operative position into the first operative position; and c) a handle mounted for movement relative to the housing in first and second opposite directions, the handle having a hand-graspable portion that can be repositioned by drawing the hand-graspable portion in a forward direction to thereby move the handle in the first direction, the handle causing the lever to move from the second operative position towards the first operative position as the handle moves in the first direction, and a lock mechanism that is placeable selectively in first and second states, the lock mechanism in the first state preventing the handle from moving in the first direction so as to cause the lever to move from the second operative position into the first operative position, wherein the housing defines a cup-shaped receptacle and the handle is mounted in the cup-shaped receptacle and protrudes from the cup-shaped receptacle with the latch arm in the unlatched position with the handle moved in the second direction to cause the latch arm to be placed in the unlatched position, wherein the housing has a flat wall with forwardly and rearwardly facing surfaces, and an opening therethrough and with the lock mechanism in the first state the post projects from forwardly of the flat wall through the opening and the groove is situated rearwardly of the flat wall.

* * * * *